US006564418B1

(12) United States Patent
Favagrossa

(10) Patent No.: US 6,564,418 B1
(45) Date of Patent: May 20, 2003

(54) FLAG ELEMENT FOR MOTOR VEHICLE WASHING BRUSHES AND BRUSH MAKING METHOD

(76) Inventor: Francesco Favagrossa, Via Lepanto, 51, 26040 Roncadello (IT)

( * ) Notice: Subject to any disclaimer, the term of this patent is extended or adjusted under 35 U.S.C. 154(b) by 0 days.

(21) Appl. No.: 09/561,129

(22) Filed: Apr. 28, 2000

(30) Foreign Application Priority Data

Sep. 28, 1999 (IT) ..... MI99A2017

(51) Int. Cl.[7] ..... B60S 3/06
(52) U.S. Cl. ..... 15/230.16; 15/97.3; 15/DIG. 2
(58) Field of Search ..... 15/230.16, 97.3, 15/DIG. 2

(56) References Cited

U.S. PATENT DOCUMENTS 3,512,204 A * 5/1970 Jagiel
4,288,884 A * 9/1981 Bahls
5,623,741 A * 4/1997 Clark
5,699,579 A * 12/1997 Burger
5,784,748 A * 7/1998 Belanger et al.
5,813,076 A * 9/1998 Belanger et al.
5,884,355 A * 3/1999 De Guzman
6,035,482 A * 3/2000 Belanger et al.

* cited by examiner

*Primary Examiner*—Randall E. Chin
(74) *Attorney, Agent, or Firm*—Hedman & Costigan, P.C.

(57) ABSTRACT

The present invention relates to a flag element for making motor vehicle washing brushes, the flag element comprising an elongated plate-like element having a central portion therefrom extend fringes obtained by cutting with different lengths the plate-like element. A method for making a motor vehicle washing brush is also disclosed, as an integral part of the invention.

5 Claims, 4 Drawing Sheets

FLAG ELEMENT FOR MOTOR VEHICLE WASHING BRUSHES AND BRUSH MAKING METHOD

BACKGROUND OF THE INVENTION

The present invention relates to a flag element for making motor vehicle and the like washing brushes.

The invention further relates to a method for making the motor vehicle washing brushes.

As is known, conventional motor vehicle washing brushes are made starting from flag elements which usually comprise a plurality of plastic material bristles or stems, supported by supporting elements applied to a rotary central shaft.

The washing portion of such a brush is conventionally made from bristles which directly contact the parts of the motor vehicles being washed such as cars, vans, pick-up's, buses, trucks, locomotives, rail vehicles and the like.

A drawback of prior motor vehicle washing brushes is that these brushes are quickly worn because of the contact friction against the parts being washed, and because the end portions or "fringes" of the flag elements are frequently jammed by parts of the motor vehicles being washed.

Such a jamming, moreover, also damages parts of the motor vehicle being washed, which parts can be stripped away from the motor vehicle before a braking of the bristles.

SUMMARY OF THE INVENTION

Accordingly, the aim of the present invention is to overcome the above mentioned drawbacks, by providing a flag element for motor vehicle washing brushes, which generate a friction in turn generating a longitudinal stress, i.e. parallel to the fringe length or extension, which is efficiently damped, with a consequent very small wearing.

Within the scope of the above mentioned aim, a main object of the present invention is to provide a motor vehicle washing brush flag element, which is made starting from closed cell foamed plastic materials, such as ethylvinylacetate, or foamed EVA, which can be cut into strips and then collected in fringes, and in which the cross stress due to a contact against a motor vehicle part is efficiently damped by damping means provided at the base of the fringes.

Another object of the present invention is to provide such a motor vehicle washing brush flag element which does not jam against the motor vehicle being washed and, more specifically, against projecting parts of said motor vehicle.

Another object of the present invention is to provide such a motor vehicle washing brush flag element which is very reliable and safe in operation.

Yet another object of the present invention is to provide such a motor vehicle washing brush flag element which can be easily made starting from closed cell foamed plastic material sheets, and with a thickness from 2 mm to 15 mm.

Yet another object of the present invention is to provide such a motor vehicle washing brush flag element which is very competitive from a mere economic standpoint.

Yet another object of the present invention is to provide a method for making motor vehicle washing brush flag elements which is very simple and quick and allows to make flag elements having very high efficiency, reliability and duration or life properties.

According to one aspect of the present invention, the above mentioned aim and objects, as well as yet other objects, which will become more apparent hereinafter, are achieved by a flag element for motor vehicle washing brushes, characterized in that said flag element comprises an elongated plate element having a central portion therefrom extend fringes made by cutting with different cutting lengths said plate element.

BRIEF DESCRIPTION OF THE DRAWINGS

Further characteristics and advantages of the present invention will become more apparent hereinafter from the following detailed disclosure of a preferred, though not exclusive, embodiment of a flag element for making motor vehicle washing brushes, which is illustrated, by way of an indicative, but not limitative, example, in the figures of the accompanying drawings, where.

DESCRIPTION OF THE PREFERRED EMBODIMENT

Figure 1:
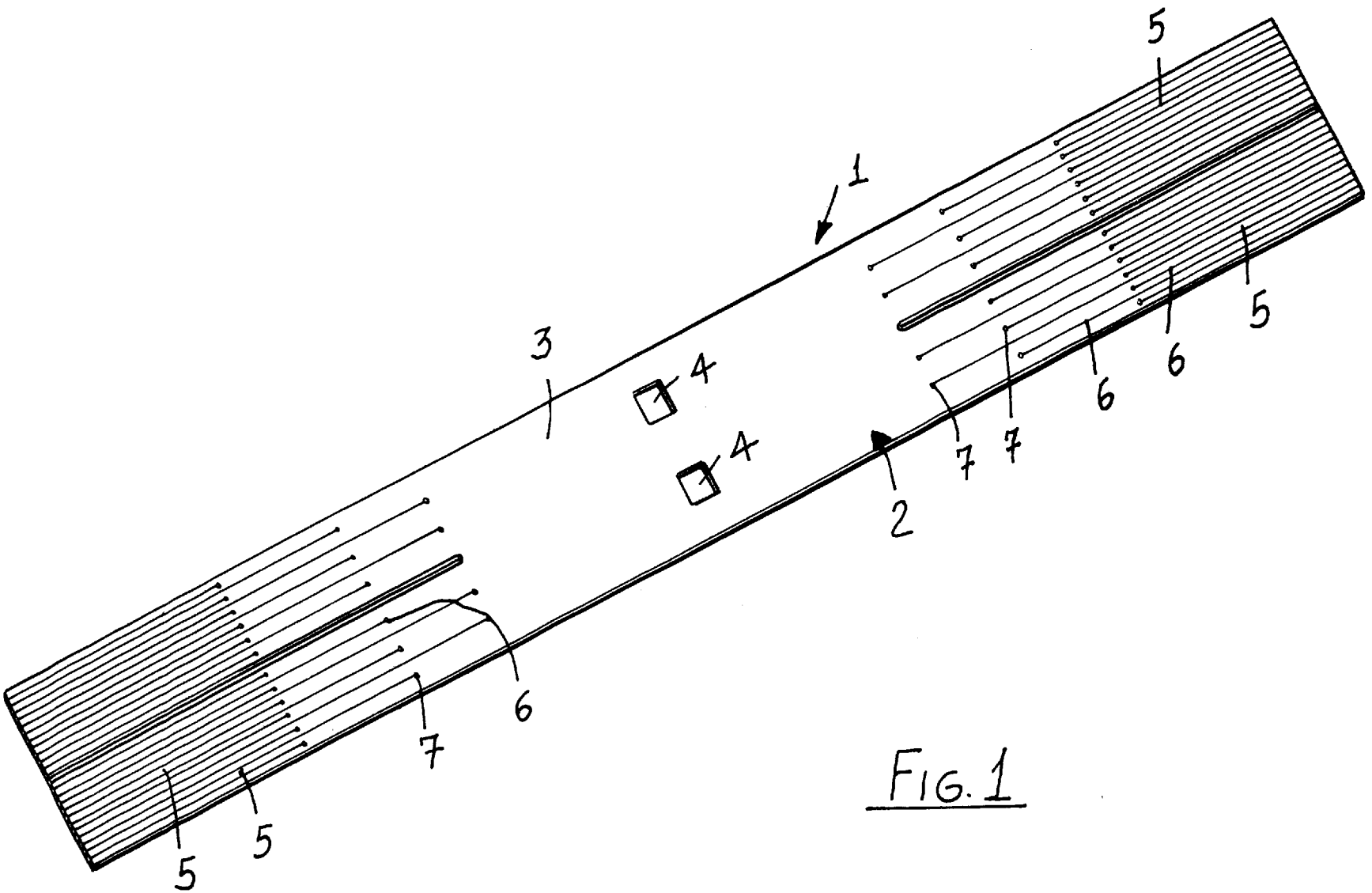
FIG. 1 is an extended flat view showing a plate-like element for making a motor vehicle washing brush flag element according to the invention.
Figure 2:
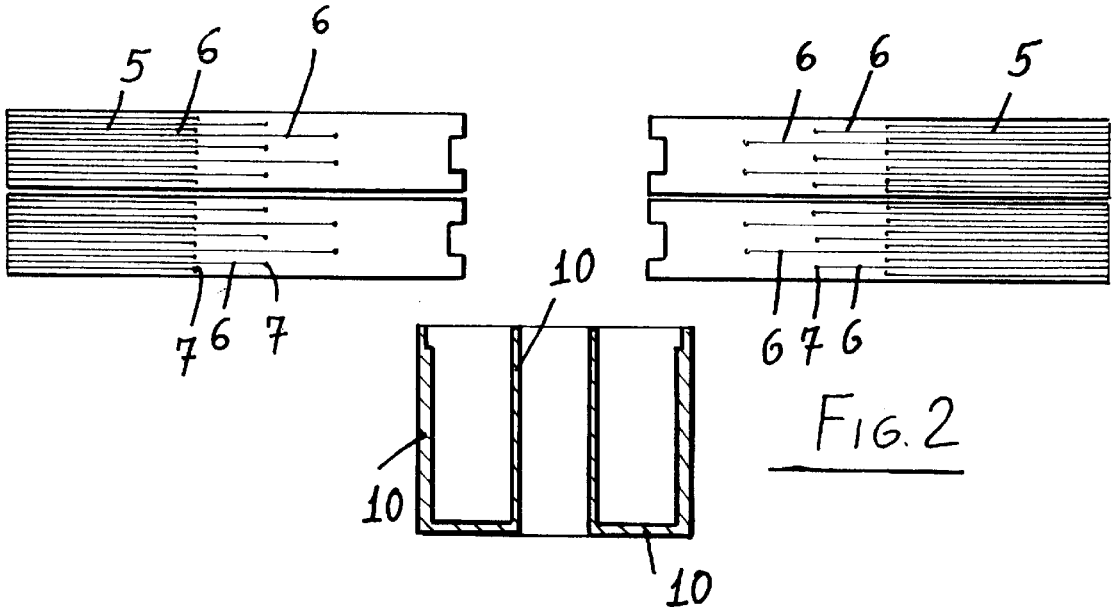
FIG. 2 is a schematic view showing a mold insertion step, in which a plurality of flag elements, folded both longitudinally and transversely, are introduced into a mold.
Figure 3:
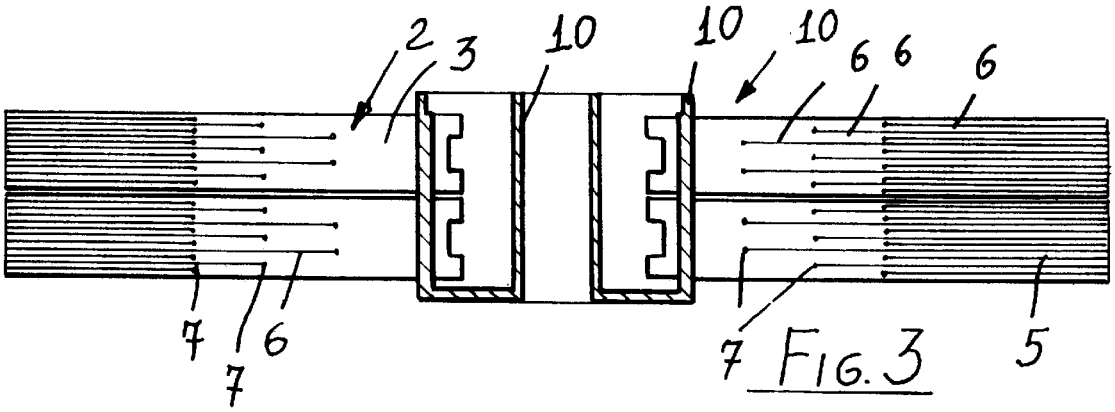
FIG. 3 is a cross-sectional view showing the flag elements as engaged in the mold.
Figure 4:
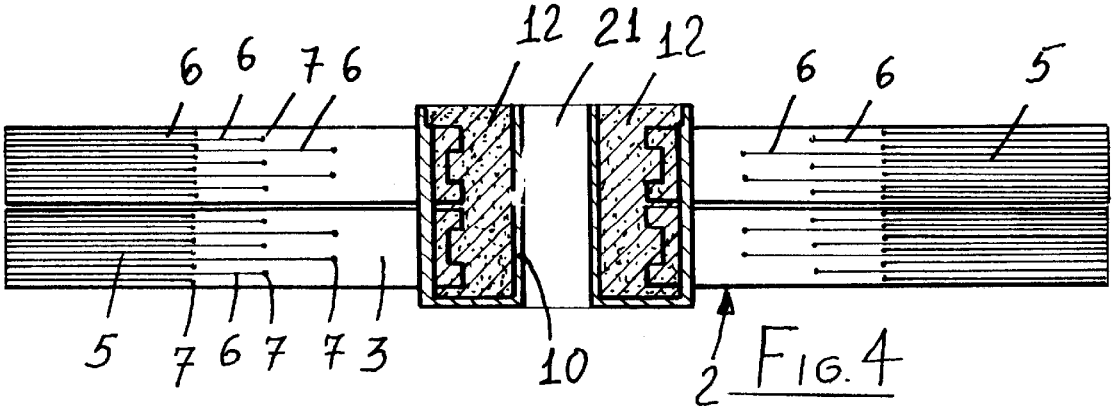
FIG. 4 is a further cross-sectional view illustrating a plastic material casting step for embedding in said plastic material a central portion of the flag elements.
Figure 7:
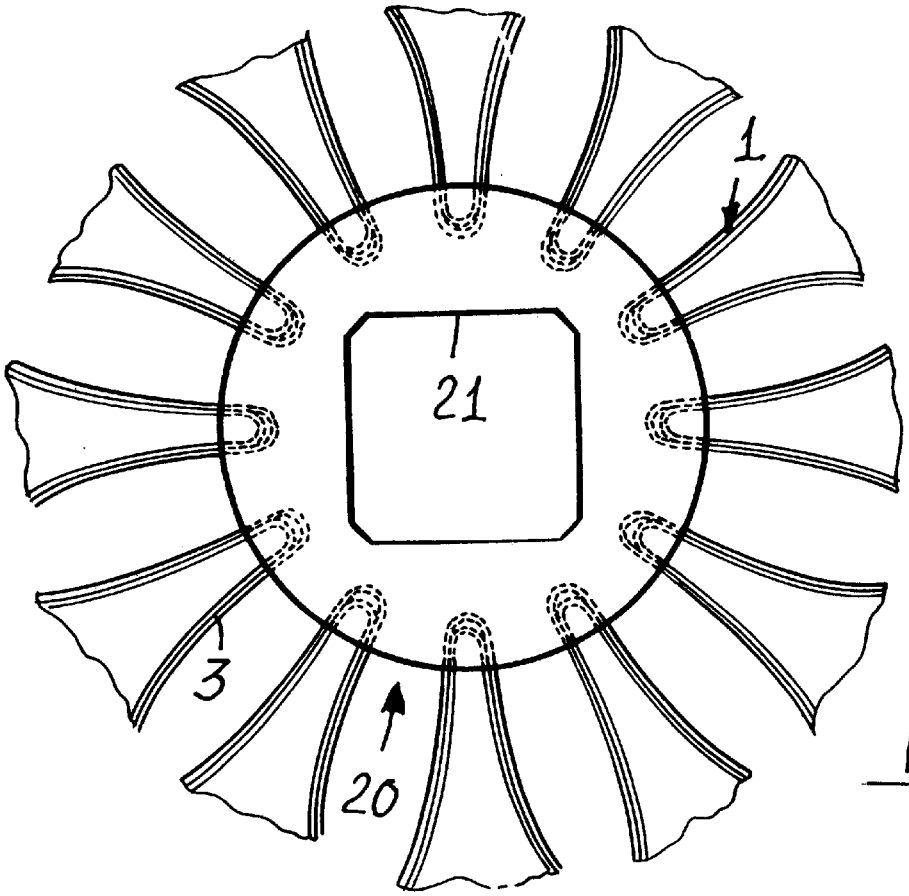
FIG. 7 is a further top plan view showing a sector made by a plurality of flag elements.
Figure 5:
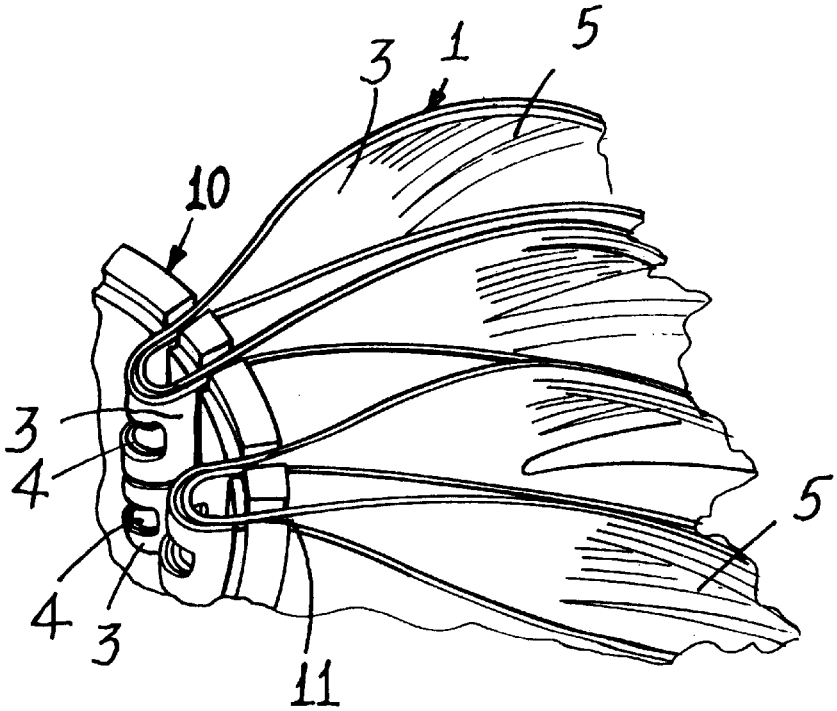
FIG. 5 is a perspective view showing the coupling of the mold and folded flag elements.
Figure 8:
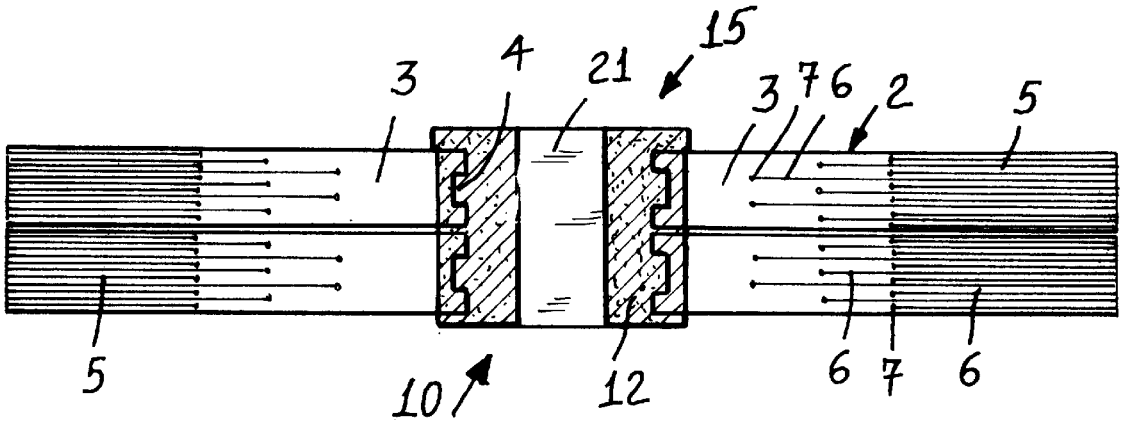
FIG. 8 illustrates a sector including two rows of flag elements, as seen in a diametrical cross-sectional representation.
Figure 6:
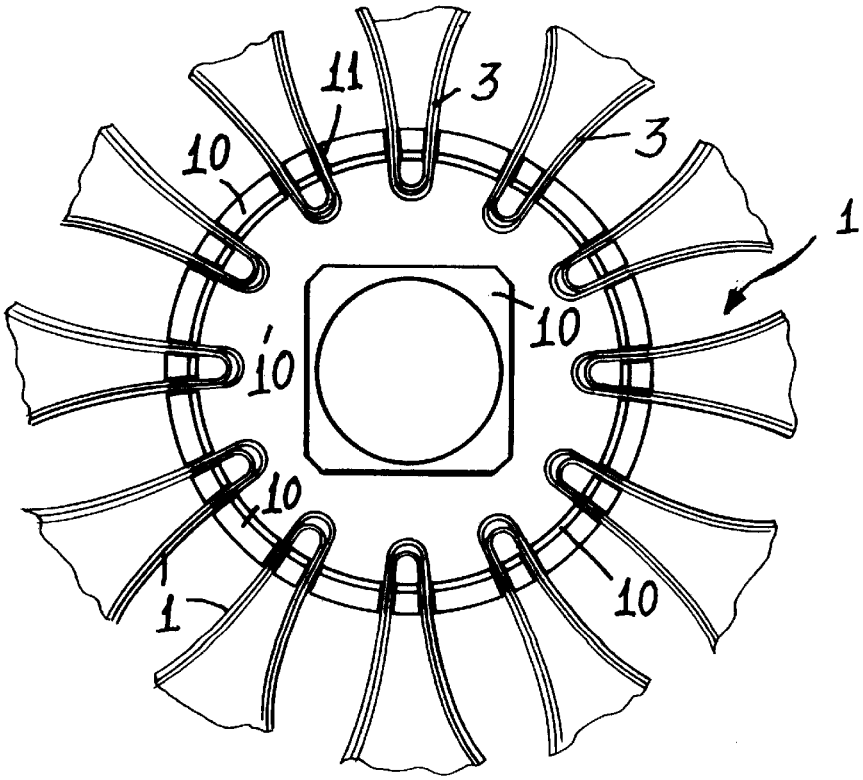
FIG. 6 is a schematic view showing a top plan view of the mold.

With reference to the number references of the above mentioned figures, the flag element for making washing brushes, specifically designed for motor vehicles and the like, according to the present invention, which has been generally indicated by the reference number 1, comprises a plate-like element 2, of elongated shape, which is advantageously made of any suitable closed cell foamed plastic materials, such as a foamed EVA material, or a felt and the like materials.

More, specifically, the above mentioned flag element 1 comprises a substantially rectangular plate-like element having two cross minor sides and two major longitudinal sides. The flag is made of a closed cell foamed plastic material, having a specific weight from 100 to 500 kg/m$^3$.

The plate-like element 2 is provided with a structural central portion 3, having a pair of central openings 4, which are symmetrically arranged with respect to the middle longitudinal axis.

At their end portions, are provided respective fringes 5, which are made by cutting, with different lengths, cuts 6 through the plate-like element 2.

The provision of cuts 6 of different lengths represents a main feature of the present invention.

In particular, first cuts are provided, starting at the structural region, which define a plurality of strips, which are in turn divided by second cuts, defining minor strips, in turn defined by third cuts which, practically, provide the end fringe portions which have a length less than of conventional fringes, thereby providing a very high strength against possible cutting, tearing and/or wearing out forces on the individual fringes or fringe sets.

Moreover, in the starting region of each cut 6, a circular slot 7 operating as a fitting element practically nullifying the cross stresses is provided.

Finally, from substantially the middle of each minor side of the plate element extends a further central folding cut (not numbered) provided, inter alia, for facilitating the longitudinal folding of the plate element 1, and extending substantially up to the region of the mentioned circular slots 7.

With the disclosed arrangement, the longitudinal stresses caused by a contact friction are efficiently damped since the fringe practically doubles its width, according to a set pitch defined by the several cut-outs.

Actually, the friction cross stress is efficiently damped by the provision of the circular slots 7 which, owing to their fitting operation, would distribute and nullify the cross stresses of forces.

The jamming phenomena are moreover reduced since the subject novel washing brushes have fringes provided with a small length thin portion.

Because of the above disclosed features, the flag elements are prevented from gripping the projecting motor vehicle parts being washed, the fringes being moreover prevented from introducing into possible gaps or hollows of the washed parts.

Thus, the flag element fringes cannot jam against motor vehicle projecting parts.

The shearing stress, moreover, is suppressed by the provision of the above mentioned circular slots and since, in our novel washing brushes, the starting region of the fringes has a width which is much greater than that of prior fringes and, accordingly, being not affected by the stress due to the brush friction.

In order to make the individual brush sector 15 to be stacked for forming a full washing brush, the plate-like elements 1 are longitudinally folded and substantially along the a middle longitudinal folding cut, then cross folded to be connected to suitable molds 10, having a cylindric shape with axial slots 11 through their surface, for engaging therein the folded plate-like element 2.

Then, a plastic material, indicated by the reference number 12, is cast for making the above mentioned brush sector 15, which will be provided with a square or polygonal axial hole 21 for engaging therein the brush driving shaft, said brush being made by mutually coupling several brush sectors 15.

After the curing of the plastic material, the brush sector 15 are withdrawn from the mold and then arranged, adjoining one another, on the driving shaft to provide a desired-size washing brush.

From the above disclosure it should be apparent that the invention fully achieves the intended aim and objects.

In particular, the fact is to be pointed out that, by the above disclosed cut arrangement, the flag element 1 will have a duration or useful life much greater than that of prior washing brushes, since both the cross stress and the longitudinal and shear stresses are fully absorbed.

The invention, as disclosed, is susceptible to several modifications and variations, all of which will come within the scope of the invention.

Moreover, all of the constructional details, can be replaced by other technically equivalent elements.

In practicing the invention, the used materials, as well as the contingent size and shapes, can be any, depending on requirements.

What is claimed is:

1. A flag element for making motor vehicle washing brushes, said flag element comprising a substantially rectangular plate element, said rectangular plate element having two minor cross sides and two major longitudinal sides, having a thickness from 2 mm to 1.5 cm and including a structural central portion defining a plurality of fringes made by providing a plurality of longitudinal cuts through said plate element, said longitudinal cuts having offset starting regions, wherein said longitudinal cuts comprise first cuts, defining a plurality of strips, there through are provided second cuts, dividing said strips into smaller strips, said smaller strips being in turn divided by third cuts, defining said fringes, circular slots being provided at said cut offset starting regions, and wherein a further central longitudinal folding cut extends substantially from a middle portion of each of said two minor cross sides to said cut offset starting regions.

2. A flag element, according to claim 1, wherein said flag element comprises, through said structural central portion thereof, at least two openings which are symmetrically arranged with respect to a middle longitudinal line of said flag element.

3. A flag element, according to claim 2, wherein said flag element is made of a closed cell foamed plastic material having a specific gravity from 100 to 500 $kg/m^3$.

4. A flag element, according to claim 1, wherein said closed cell foamed plastic material is foamed EVA.

5. A flag element, according to claim 1, wherein said flag element is made of a felt material.

* * * * *